US006247283B1

(12) United States Patent
Slabaugh et al.

(10) Patent No.: US 6,247,283 B1
(45) Date of Patent: Jun. 19, 2001

(54) DRY WALL PATCH

(76) Inventors: Bradley K. Slabaugh, 52 Yosemite Pl., Livermore, CA (US) 94550; Randall J. Slabaugh, 1965 Encima Dr., Concord, CA (US) 94519

( * ) Notice: Subject to any disclaimer, the term of this patent is extended or adjusted under 35 U.S.C. 154(b) by 0 days.

(21) Appl. No.: 09/538,870

(22) Filed: Mar. 29, 2000

(51) Int. Cl.[7] ..... E02D 37/00
(52) U.S. Cl. ..... 52/514; 52/514.5
(58) Field of Search ..... 52/514, 514.5, 52/365

(56) References Cited

U.S. PATENT DOCUMENTS

| | | | | |
|---|---|---|---|---|
| 276,499 | | 4/1883 | Story . | |
| 4,152,877 | | 5/1979 | Green . | |
| 4,406,107 | * | 9/1983 | Schoonbeck | 52/514 |
| 4,471,594 | | 9/1984 | Doyle . | |
| 4,820,564 | * | 4/1989 | Cologna et al. | 428/63 |
| 5,018,331 | | 5/1991 | Forzano . | |
| 5,960,603 | | 10/1999 | Redden et al. . | |

* cited by examiner

*Primary Examiner*—Carl D. Friedman
*Assistant Examiner*—Chi Nguyen
(74) *Attorney, Agent, or Firm*—Jack Lo

(57) ABSTRACT

The present dry wall patch comprises a disc with a threaded rim. A lock nut is strongly attached to one side of the disc, and a bolt is inserted through the disc from the opposite side and threaded tightly into the nut. A wrench is applied to the bolt to turn the disc into a hole on a wall until the disc is recessed slightly within the hole. The nut includes teeth that dig into the disc to hold it in position while the bolt is being wrenched. The bolt is removed after the disc is in position. The hole is filled with spackle and sanded until completely flush with the wall. Other embodiments include a polygonal block screwed to the disc for mating with a turning tool, radial slots cut into the face of the disc for mating with a turning tool, holes drilled into the disc for mating with a turning tool, and a handle positioned through a block screwed to the disc.

8 Claims, 4 Drawing Sheets

DRY WALL PATCH

BACKGROUND OF THE INVENTION

1. Field of the Invention:

This invention relates generally to patches for repairing dry walls.

2. Prior Art

When a dry wall or sheet rock wall is damaged with a deep dent or hole, the conventional repair method comprises adhering a rigid sheet over the damaged area, and covering the sheet with spackle. Since all the repair materials are added to the outside surface of the wall, the finished repair forms a noticeable bump on the wall.

Other repair devices and methods are known in the prior art. U.S. Pat. No. 5,960,603 to Redden et al. discloses a dry wall patch comprising a flexible sheet hinged across its center. A hole smaller than the sheet is cut into a wall along a line drawn around a template. The sheet is bent and inserted into the hole. The sheet is pushed in to expand it within the hole, and covered with spackle. However, the sheet tends to pop back out before the plaster dries. Even after the plaster dries, the flexible sheet can be pushed in with moderate force and cause the spackle to crack.

U.S. Pat. No. 5,018,331 to Forzano discloses a patch comprising a disc hinged across its center. The disc is folded, inserted through a hole cut into a wall, and expanded. The disc is held against the back surface of the wall by temporary straps, and the hole is filled with spackle. Because the disc is attached to the back surface of the wall, the entire thickness of the hole must be filled with spackle, which is too thick to dry quickly. Further, the disc can be dislodged with moderate force even after the spackle dries.

U.S. Pat. No. 4,471,594 to Doyle discloses a patch comprising a disc with a long bolt loosely threaded through its center. The disc is positioned on the back surface of a hole cut into an outer wall. The long bolt is turned until it engages an inner wall to press the disc against the outer wall. The disc is prevented from rotating while the large bolt is being turned by holding a smaller bolt. Because the disc is attached to the back surface of the outer wall, the entire thickness of the hole must be filled with spackle, which is too thick to dry quickly. The large bolt is threaded through a nut simply glued to the disc. Since no torque is applied between the bolt and the disc while the bolt is advanced through the disc, the nut does not have to be strongly fixed to the disc.

U.S. Pat. No. 4,152,877 to Green discloses a patch comprising a sheet clipped to the back surface of a wall. Again, a thick layer of spackle is required to fill the hole, and the sheet can be dislodged with moderate force.

U.S. Pat. No. 4,406,107 to Schoonbeck discloses a patch comprising a larger disc glued to the back surface of a wall. A smaller disc is supported in front of the larger disc by a bolt extending there between. The spacing between the discs is adjusted by turning loose nuts on the bolt. The smaller disc is positioned closer to the outer surface of the wall to reduce the spackle required. Since no torque is applied between the bolt and the larger disc while the smaller disc is advanced along the bolt, the nut does not have to be strongly fixed to the larger disc. U.S. Pat. No. 276,499 to Story discloses a threaded wood plug for filling a threaded hole in a board. The hole must be threaded to receive the plug.

OBJECTIVES OF THE INVENTION

Accordingly, the objectives of the present dry wall patch are:

to permanently repair a damaged area on a dry wall;

to provide a completely flush surface when finished;

to form a strong repair;

to require a minimum of spackle for quick drying;

to be simple to install; and to be very simple to manufacture.

Further objectives of the present invention will become apparent from a consideration of the drawings and ensuing description.

BRIEF SUMMARY OF THE INVENTION

The present dry wall patch comprises a disc with a threaded rim. A lock nut is strongly attached to one side of the disc, and a bolt is inserted through the disc from the opposite side and threaded tightly into the nut. A wrench is applied to the bolt to turn the disc into a hole on a wall until the disc is recessed slightly within the hole. The nut includes teeth that dig into the disc to hold it in position while the bolt is being wrenched. The bolt is removed after the disc is in position. The hole is filled with spackle and sanded until completely flush with the wall. Other embodiments include a polygonal block screwed to the disc for mating with a turning tool, radial slots cut into the face of the disc for mating with a turning tool, apertures drilled into the disc for mating with a turning tool, and a handle positioned through a block screwed to the disc.

DRAWING REFERENCE NUMERALS

Figure 1:
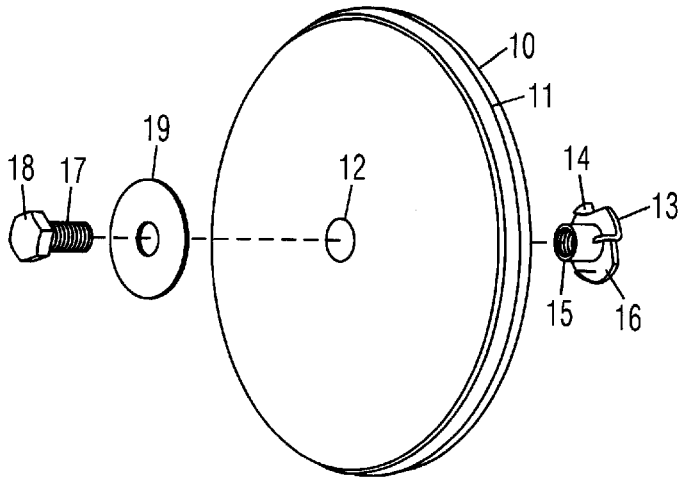
FIG. 1 is an exploded view of a first embodiment of the present dry wall patch.

| | |
|---|---|
| 10. Disc | 11. Threaded Edge |
| 12. Aperture | 13. Lock Nut |
| 14. Teeth | 15. Threaded Sleeve |
| 16. Flange | 17. Bolt |
| 18. Polygonal Head | 19. Washer |
| 20. Wall | 21. Hole |
| 22. Bevel | 23. Turning Tool |
| 24. Tape | 25. Filler Material |
| 30. Block | 31. Disc |

-continued

| DRAWING REFERENCE NUMERALS | |
|---|---|
| 32. Screws | 40. Handle |
| 41. Block | 42. Disc |
| 43. Screws | 50. Apertures |
| 51. Disc | 52. Turning Tool |
| 53. Pins | 54. Handle |
| 60. Slots | 61. Disc |
| 62. Turning Tool | 63. Bars |
| 64. Handle | 70. Slots |
| 71. Disc | 72. Turning Tool |
| 73. Ridges | 74. Plate |
| 75. Handle | |

DETAILED DESCRIPTION OF THE INVENTION

Figure 2:
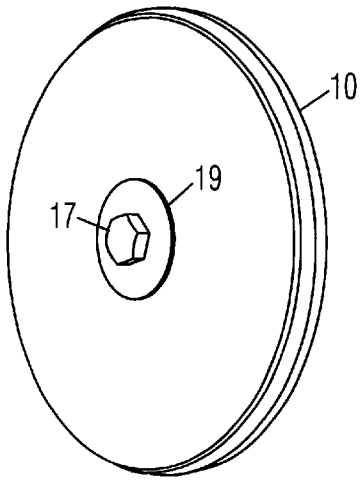
FIG. 2 is a front perspective view of the patch when assembled.
Figure 3:
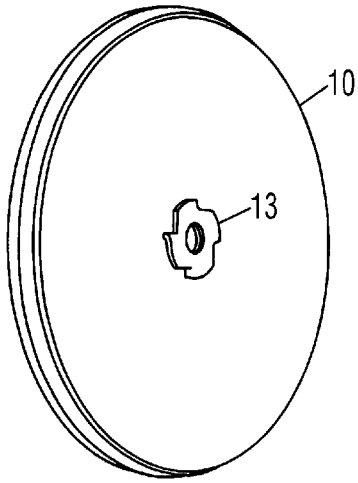
FIG. 3 is a rear perspective view of the patch when assembled.

FIGS. 1–3:

A first embodiment of the present dry wall patch is shown in FIGS. 1–3. It comprises a circular disc 10 with a threaded rim 11. Disc 10 is preferably made of wood for strength and economy, but it may be made of other materials, such as plastic, fiberglass, etc. It may be fabricated with power tools or molded. Disc 10 may be of any diameter for repairing damage of any size. An aperture 12 is drilled through the axis of disc 10. A lock nut 13 is attached to an inner side of disc 10. Nut 13 includes teeth 14 and a tubular sleeve 15 extending in the same direction from a flange 16. Sleeve 15 is inserted into aperture 12 from the inner side of disc 10 until teeth 14 are fully penetrated into disc 10. Alternatively, another type of lock nut may be used, or a nut and a lock washer. A tool mating member or bolt 17 with a polygonal head 18 is inserted through a washer 19, through aperture 12 from the outer side of disc 10, and screwed tightly into nut 13. Bolt 17, nut 13, and disc 10 are all threaded for tightening in the same direction, which is preferably clockwise.

Figure 4:
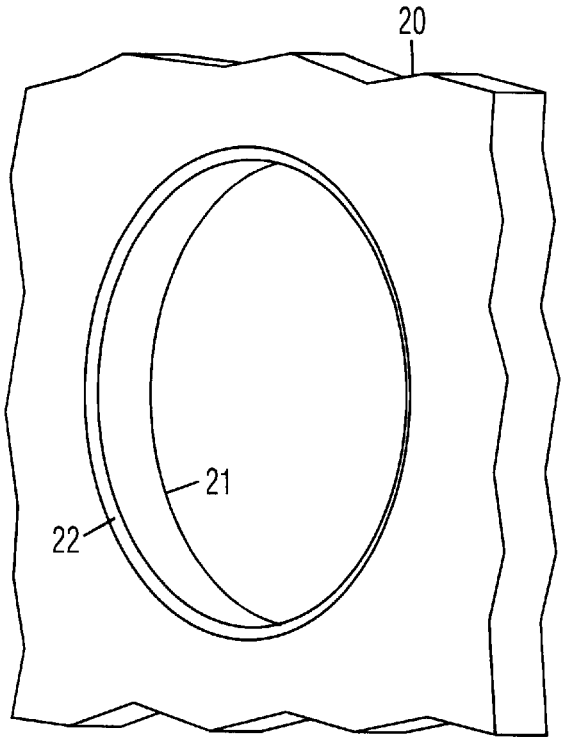
FIG. 4 a front perspective view of a hole cut into a wall for receiving the patch.

FIGS. 4–7:

To use the patch, disc 10 is placed over a damaged area on a wall 20. A close outline of the disc is drawn on wall 20, and a hole 21 is cut inside the outline with a saw, as shown in FIG. 4. The diameter of hole 21 is preferably slightly smaller than the disc. A bevel 22 is cut into the rim of hole 21 with a knife.

Figure 5:
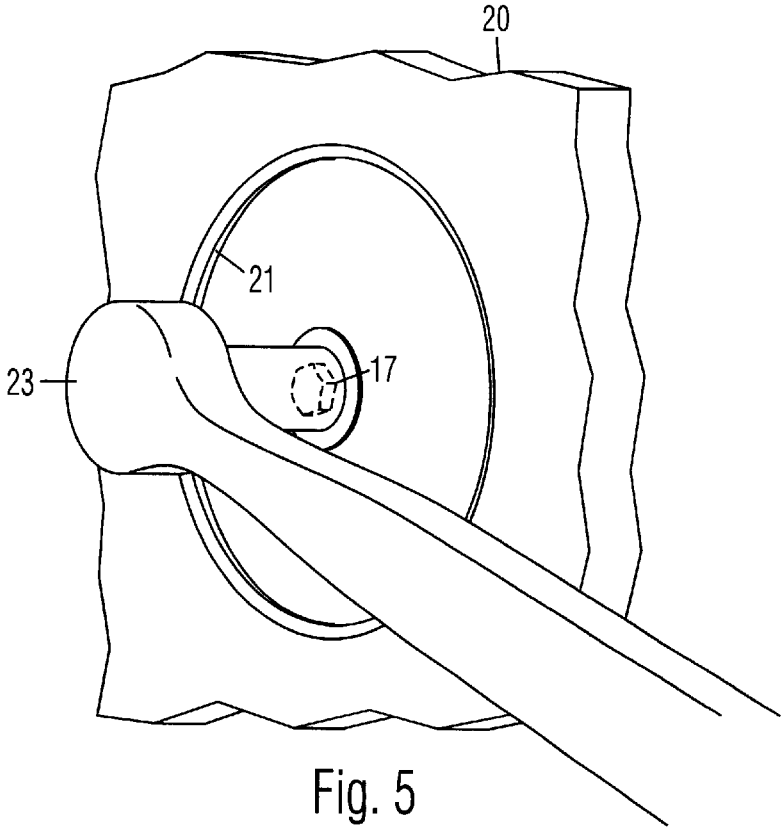
FIG. 5 is a front perspective view of the patch being wrenched into the hole.
Figure 6:
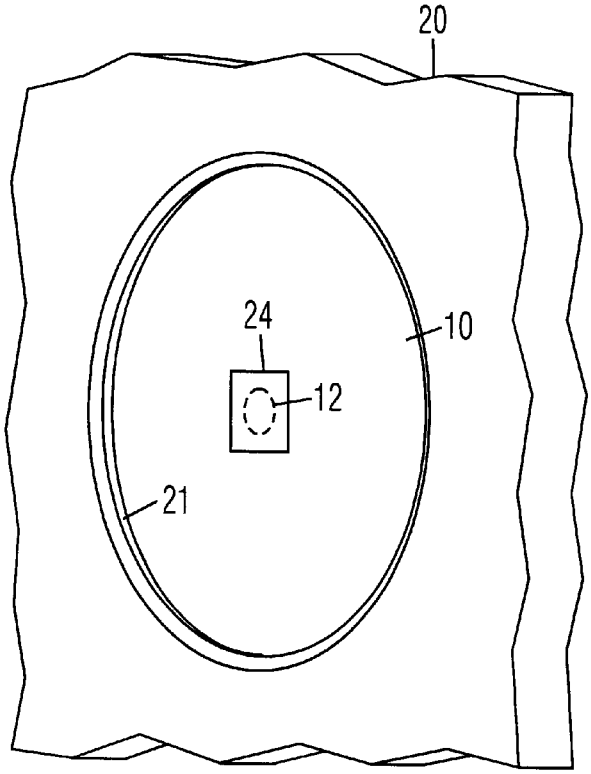
FIG. 6 is a front perspective view of the patch after its bolt is removed.

In FIG. 5, disc 10 is wrenched into hole 21 with a turning tool 23, such as a wrench, which is applied to bolt 17. A high torque must be applied to disc 10 to screw it into hole 21 because disc 10 cuts a thread in hole 21 as it is advanced. Disc 10 can self-tap into a hole on any wall that is made of a soft enough material, such as dry walls, plaster walls, etc. Turning tool 23 must have a relatively long handle which is perpendicular to the axis of disc 10 to apply enough torque. Since bolt 17 and disc 10 are threaded for tightening in the same direction, bolt 17 does not rotate relative to disc 10 while disc 10 is being wrenched into hole 21. Critically, nut 13 (FIG. 3) also does not rotate relative to disc 10 under high torque, because its teeth are firmly planted in disc 10. Disc 10 is advanced into hole 21 until it is slightly recessed or countersunk, as shown in FIG. 6. The threaded edge of disc 10 is locked tightly against the wall of hole 21.

Figure 7:
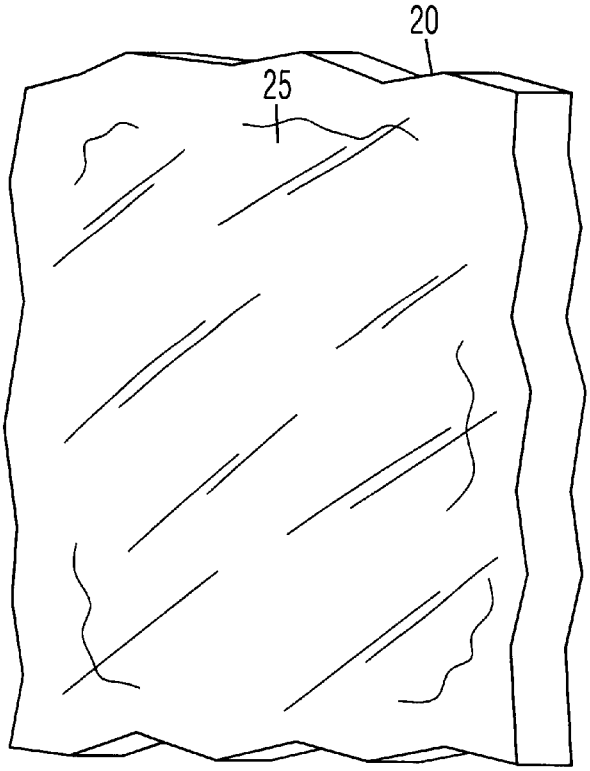
FIG. 7 is a front perspective view of the wall after the hole is filled with spackle and sanded smooth.

Bolt 17 is removed, and aperture 12 in disc 10 is covered with a piece of tape 24, which is preferably a mesh tape. Hole 21 is filled with a filler material 25, such as spackle. A minimum of filler material is required because disc 10 is close to the outer surface of wall 20, so that drying time is relatively short. Filler material 25 is sanded until completely flush with wall 20, as shown in FIG. 7. Texture and paint may be subsequently applied. Since disc 10 is made of a rigid and strong material, and it is tightly screwed into hole 21, it forms a strong repair.

Figure 8:
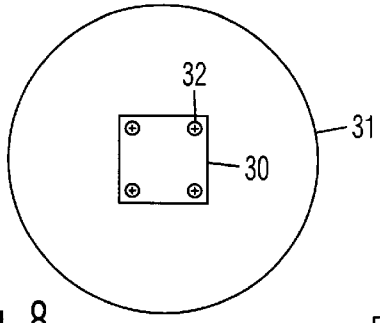
FIG. 8 is a front view of a second embodiment of the patch.
Figure 9:
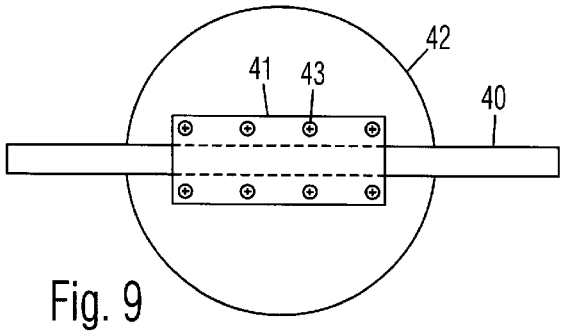
FIG. 9 is a front view of a third embodiment of the patch.
Figure 10:
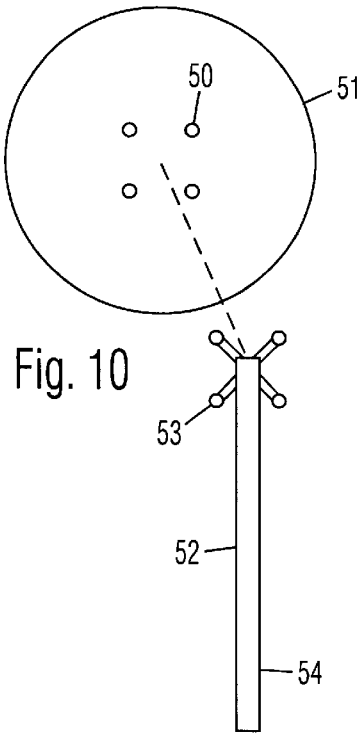
FIG. 10 is a front view of a fourth embodiment of the patch.
Figure 11:
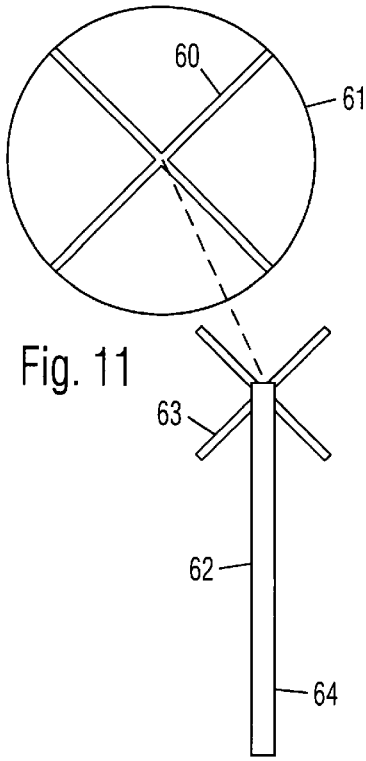
FIG. 11 is a front view of a fifth embodiment of the patch.
Figure 12:
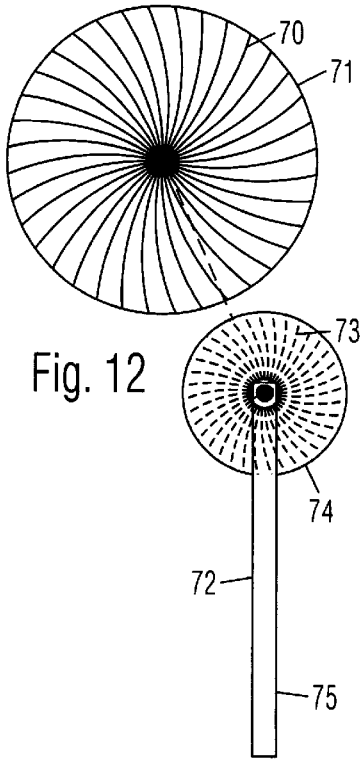
FIG. 12 is a front view of a sixth embodiment of the patch.

FIGS. 8–12:

Additional embodiments of the repair patch are possible. In FIG. 8, a tool mating member comprising a polygonal block 30, such as a wood block, screwed to a threaded disc 31 with a plurality of screws 32. Block 30 is for mating with a conventional wrench, and is removed from disc 30 by removing screws 32. In FIG. 9, a handle 40 is positioned through a block 41, which is attached to a threaded disc 42 with screws 43. Handle 40 is used for turning disc 42. Handle 40 and block 41 are removed from disc 42 by removing screws 43. In FIG. 10, a tool mating member comprising a plurality of apertures 50 are arranged in radial positions around a center of a threaded disc 51. Apertures 50 are for mating with a turning tool 52 comprising pins 53 in radial positions at one end of a handle 54. In FIG. 11, a tool mating member comprising a plurality of straight slots 60 are arranged in radial positions around a center of a threaded disc 61. Slots 60 are for mating with a turning tool 62 comprising bars 63 in radial positions at one end of a handle 64. In FIG. 12, a tool mating member comprising a plurality of curved slots 70 are arranged in radial positions around a center of a threaded disc 71. Slots 70 are for mating with a turning tool 72 comprising curved ridges 73 in radial positions on the face of a plate 74 at one end of a handle 75. Other types of tool mating members may also be used with any suitable type of turning tool.

SUMMARY AND SCOPE

Accordingly, the present dry wall patch permanently repairs a damaged area on a wall. It provides a completely flush surface when finished. It forms a strong repair. It requires a minimum of plaster for quick drying. It is simple to install. It is also very simple to manufacture. It may be used for repairing other types of walls in addition to dry walls.

Although the above description is specific, it should not be considered as a limitation on the scope of the invention, but only as an example of the preferred embodiment. Many variations are possible within the teachings of the invention. the scope of the invention should be determined by the appended claims and their legal equivalents, not by the examples given.

I claim:

1. A wall patch for repairing a damaged area on a wall, comprising:

a circular disc with a threaded rim for being screwed into a hole cut around said damaged area on said wall, said threaded rim for cutting a thread in said hole as said disc is advanced;

a tool mating member on said disc for engaging a turning tool which is used for wrenching said disc into said hole on said wall wherein said tool mating member comprises a lock nut on an inner side of said disc, and a bolt with a polygonal head on an outer side of said disc and screwed into said lock nut, said bolt is positively prevented from rotating relative to said disc by said lock nut.

2. The wall patch of claim 1, wherein said tool mating member comprises a removable polygonal block generally attached to center of said disc, said block is removable from said disc after said disc is positioned within said hole in said wall.

3. The wall patch of claim 1, wherein said tool mating member comprises a removable block attached to said disc, said block includes a transverse hole for receiving there through said turning tool, said block is removable from said disc after said disc is positioned within said hole in said wall.

4. A wall patch for repairing a damaged area on a wall, comprising:

a circular disc with a threaded rim for being screwed into a hole cut around said damaged area on said wall, said threaded rim for cutting a thread in said hole as said disc is advanced;

an aperture extending through an axis of said disc;

a lock nut attached to an inner side of said disc, wherein said nut comprises a tubular sleeve positioned in said aperture of said disc, a flange around an outer end of said sleeve, and a plurality of teeth extending toward said disc from said flange, said teeth positively prevent said nut from rotating relative to said disc; and a bolt with a polygonal head, wherein said bolt is positioned in said aperture on an outer side of said disc and screwed into said nut, said bolt, said nut, and said disc are all threaded for tightening in an identical direction, said bolt for being engaged by a wrench for turning said disc into said hole.

5. A method for repairing a damaged area on a wall, comprising:

providing a disc with a threaded rim;

cutting a hole around said damaged area on said wall with a diameter smaller than a diameter of said disc; and turning said disc into said hole.

6. The method of claim 5, further including:

recessing said disc within said hole;

filling said hole with a filler material; and smoothing said filler material until flush with an outer surface of said wall.

7. The method of claim 5, further including:

providing a removable tool mating member on said disc;

applying a turning tool to said tool mating member to turn said disc into said hole; and removing said tool mating member after said disc is in position within said hole.

8. The method of claim 5, further including:

providing a removable tool mating member on said disc;

applying a turning tool to said tool mating member to turn said disc into said hole;

recessing said disc within said hole;

removing said tool mating member after said disc is in position within said hole;

filling said hole with a filler material; and smoothing said filler material until flush with an outer surface of said wall.

* * * * *